US006609955B1

(12) United States Patent
Farrow

(10) Patent No.: US 6,609,955 B1
(45) Date of Patent: Aug. 26, 2003

(54) METHOD FOR REMOVING SURFACE COATINGS

(75) Inventor: Nigel Richard Farrow, Great Yarmouth (GB)

(73) Assignee: Farrow System Limited (GB)

( * ) Notice: Subject to any disclaimer, the term of this patent is extended or adjusted under 35 U.S.C. 154(b) by 0 days.

(21) Appl. No.: 09/857,513

(22) PCT Filed: Dec. 6, 1999

(86) PCT No.: PCT/GB99/04108

§ 371 (c)(1),
(2), (4) Date: Aug. 7, 2001

(87) PCT Pub. No.: WO00/34011

PCT Pub. Date: Jun. 15, 2000

(30) Foreign Application Priority Data

Dec. 4, 1998 (GB) ..... 9826683
Dec. 11, 1998 (GB) ..... 9827214

(51) Int. Cl.[7] ..... B24C 1/00
(52) U.S. Cl. ..... 451/38; 451/40; 451/75
(58) Field of Search ..... 451/38, 40, 36, 451/75

(56) References Cited

U.S. PATENT DOCUMENTS 1,966,571 A * 7/1934 Webb ..... 451/102
4,044,507 A 8/1977 Cox et al.
5,112,406 A 5/1992 Lajoie et al.
5,445,553 A * 8/1995 Cryer et al. ..... 451/39

FOREIGN PATENT DOCUMENTS

| | | |
|---|---|---|
| DE | 3 446 541 | 12/1984 |
| EP | 0 171 448 | 8/1984 |
| FR | 2 736 000 | 6/1995 |
| JP | 59 160 577 | 9/1984 |

* cited by examiner

*Primary Examiner*—M. Rachuba
(74) *Attorney, Agent, or Firm*—Factor & Partners

(57) ABSTRACT

A method of removing a coating, such as paint, varnish, biological growth or grime, from a surface, the method comprising selecting a suitable particulate solid having a particular, size of from 150–250 mm and a fluid carrier to form a spray mixture and spraying the mixture as a jet spray so as to impact and at least partially remove the coating. The hardness of the particulate solid is less than 8.0 on the Moh scale. The pressure applied to the spray mixture to generate the spray is from $3_x10^5$ to $1.5_x10^6$ $Nm^{-2}$. An apparatus comprising a blasting pot (1) and a compressor (2) to generate the spray mixture and propel it from a nozzle (5) is also disclosed. Heating may be applied to the carrier, either prior to or when mixing with the particulate solid.

13 Claims, 1 Drawing Sheet

METHOD FOR REMOVING SURFACE COATINGS

FIELD OF THE INVENTION

The invention relates to removing coatings from a surface and more particularly to removing paint, varnish or biological growth from the outer hull of a boat.

BACKGROUND OF THE INVENTION

The removal of a layer or layers from a surface by impacting an abrasive material against the layer or layers is well known. For example, grit or sand-blasting has been used for many years to clean stone buildings, painted metal surfaces such as railings and superstructures including oil rigs. The particles of grit or sand are mobilised by means of a carrier fluid, normally air or water.

The commonly used methods suffer from the drawback that damage is often caused to the material beneath those layers being removed. This is especially true where the methods are employed to remove surfaces from a relatively soft material such as wood or fibre glass. In particular, where fibre glass is being cleared, damage can be caused to the gel coat layer. The problem of damage caused is particularly acute where, for example, antique wooden objects are being cleaned or where the surface is part of a boat.

German patent application DE 195222001 (MINERALIEN WERKE) discloses the use of a mixture of solids, on of the solids having a higher density than the other, in order to clean and treat sensitive or polished surfaces such as brick or marble.

Where water is used as the carrier fluid, then its consumption using conventional methods is often quite high. Where there is a ready supply of water high consumption may not be a problem but where, due to the remoteness of a source, the water needs to be transported to the object to be cleaned, minimisation of water consumption would be advantageous.

It is an object of the present invention to provide a method which alleviates the above disadvantages. It is a further object of the present invention to minimize the usage of the carrier fluid when said fluid is a liquid.

SUMMARY OF THE INVENTION

In accordance with the invention there is provided a method of removing a coating such as paint or varnish from a surface, the method comprising:

(i) selecting a particulate solid suitable for removing the coating from the surface, the particulate solid having a particle size from 150 to 250 $\mu$m;

(ii) selecting a fluid as a carrier for the particulate solid;

(iii) distributing the particulate solid in the fluid to form a spray mixture;

(iv) generating a presurised jet of the spray mixture;

(v) impacting onto a coating, the pressurised jet of spray mixture to remove the coating.

Preferably, the particle size is from 170 to 190 $\mu$m.

The hardness of the particulate solid is preferably less than 8.0 on the Moh scale. It is particularly preferable for the hardness to be 6.0 to 7.0 on the Moh scale. The preferred particulate solid is olivine.

In one arrangement, the method includes heating the carrier fluid.

The fluid is preferably a liquid. It is particularly preferable that the liquid used is water.

The temperature of the liquid is preferably maintained below 50C. It is particularly preferable that the liquid is heated to a temperature between 25 and 40C.

The solid to liquid ratio in the jet spray is preferably approximately 2 to 1 volume for volume.

The jet advantageously is directed to impact the coating at an angle of approximately 45°.

In use, the jet is moved—preferably in a circular motion—back and forth across the coating to be removed.

The pressure of the jet is advantageously from $3_x10^5$ to $1.5_x10^6$ $Nm^{-2}$ and preferably from $4_x10^5$ to $1_x10^6$ $Nm^{-2}$.

BRIEF DESCRIPTION OF THE DRAWINGS

The present invention will now be described more particularly with reference to the accompanying drawing which shows, by way of example only, apparatus for removing a coating from a surface in accordance with the method of the invention. In the drawings.

DESCRIPTION OF THE PREFERRED EMBODIMENTS

Figure 1:
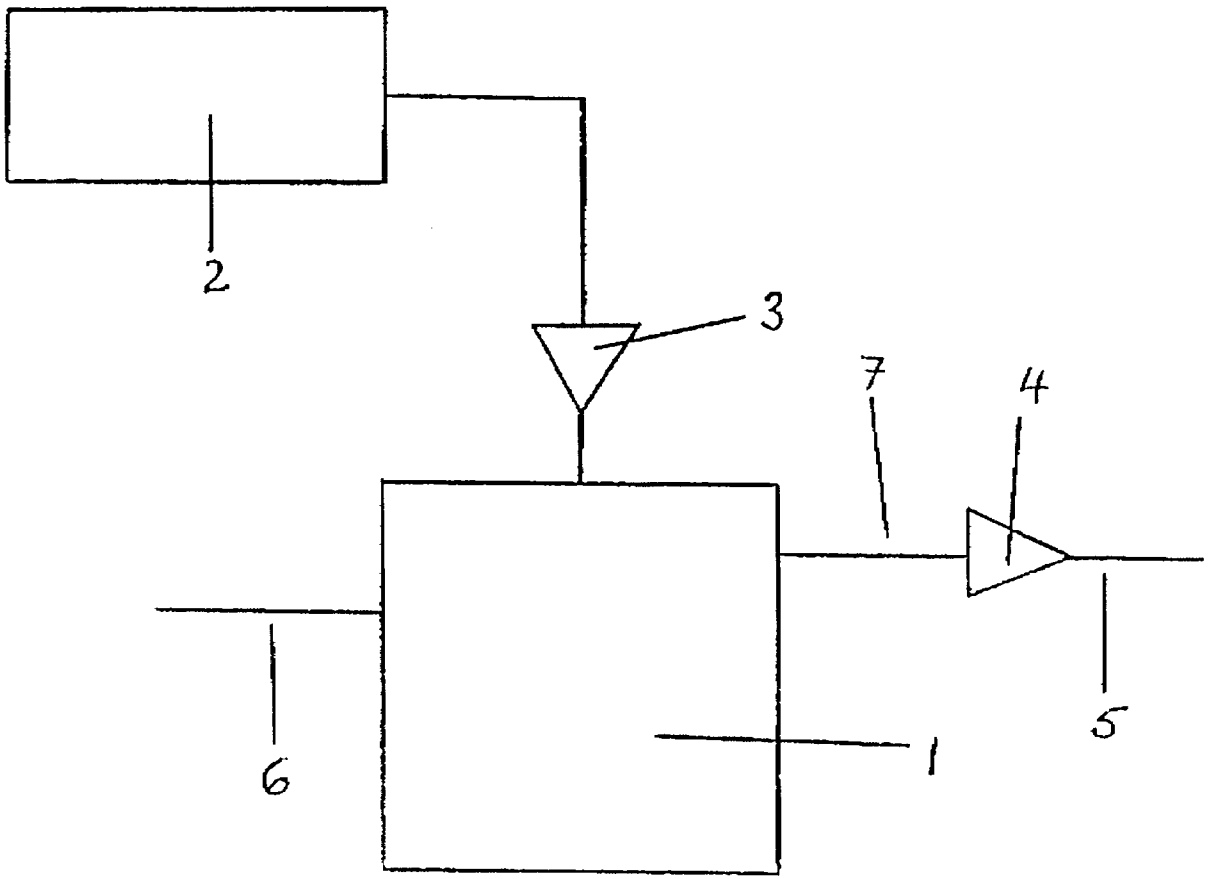
FIG. 1 is a diagrammatical view of the apparatus.

Referring initially to FIG. 1, an apparatus, suitable for use in the method detailed below, comprises a blasting pot 1 and a compressor 2. Compressed air is passed from the compressor 2, via an inlet valve 3 to the blasting pot 1. Water is supplied to the blasting pot via an inlet pipe 6. The blasting pot 1 also comprises an outlet pipe 7. The outlet pipe 7 has at its distal end a nozzle 5. Flow of material to the nozzle 5 is controlled by means of outlet valve 4.

In the method according to the invention a spray mixture of olivine and water from the domestic supply, at ambient temperature, is charged to the blasting pot 1. Compressed air at a pressure of approximately $7_x10^5$ $Nm^{-2}$ from the compressor 2 is then passed through the inlet valve 3 and pressurises the blasting pot 1 up to approximately $12_x10^5$ $Nm^{-2}$.

When a suitable pressure has been reached in the pot 1, the pressure can be released when required by opening the outlet valve 4 which is attached to the nozzle 5. The nozzle 5 is approximately 15 cm long with an outlet diameter of approximately 1.9 cm. The excess pressure forces the spray mixture of olivine and water out of the pot 1 and through the nozzle 5 at a pressure, often called the blast pressure, of approximately $6_x10^5$ $Nm^{-2}$.

When the spray mixture is ejected through nozzle 5 and directed against the surface coating as described hereinbelow, it acts to abrade the coating and remove it whilst leaving the surface beneath the coating relatively undamaged and ready to be treated or for a new coating to be applied. Where necessary, a constant water feed may be introduced via the inlet pipe 6.

The nozzle 5 can either be directed by hand or remotely. When directed by hand, the nozzle is held such as to deliver the abrading spray mixture at an angle to the coated surface. The angle is usually approximately 45°.

The distance the nozzle is held from the surface will vary according to the conditions under which spraying is being carried out, the mixture being sprayed and the coating being removed. A distance of approximately 50 cm has been found to give good results for a variety of coatings.

Although a coating can be removed by simply passing the nozzle across the surface in a single sweeping action, a number of passes could be carried out, each subtending the same angle to the surface, or subtending a different angle.

In addition , a circular motion may also be imparted to the jet spray to improve coating removal. The circular motion can be imparted manually, by the action of a jet spray or by mechanical means. For example, the action of the spray leaving the nozzle is used to induce motion in the nozzle, by giving the direction of the spray a radial component relative to the longitudinal axis of the nozzle. Alternatively, a small motor is used to move the nozzle in a circular motion.

For ease of operation, the outlet valve 4 is conveniently situated adjacent to the nozzle but can be remote from it. The nozzle can have different forms to deliver particular jet sprays where required. The width of the outlet of the nozzle should be wide enough to prevent clogging, and narrow enough to allow concentration of the force delivered by the spray onto a small enough area to be effective. For hand-held nozzles the outlet is typically 1¼ to 2½ cm in diameter.

The inlet air pressure admitted through value 3 is typically $6_x10^5$ to a $10_x10^5$ $Nm^{-2}$. Although compressed air supplied by an on-site compressor will usually be most convenient, air or other gases supplied in pressurised cylinders can also be used, for example, where no power source for a compressor is available. The pressure built up inside the pot 1, prior to spraying is typically less than $20_x10^5$ $Nm^{-2}$ and is normally less than $14_x10^5$ $Nm^{-2}$. The blast pressure can be up to $12_x10^5$ $Nm^{-2}$, but can be as low as $4_410^5$ $Nm^{-2}$. The pressure used will depend very much on the coating being removed, and on the nature of the surface which is coated.

During use, the initial pressure built up in the pot will drop back from its initial value, perhaps down to approximately $3_x10^5$ $Nm^{-2}$.

The composition of the jet spray delivered can be varied by alteration of the rate of water addition to the pot, but can also be varied by changing the operating pressures. The composition can thus be adjusted to suit the nature of the coating material being removed, and the surface which it coats. A typical composition will be between approximately 1:1 and 3:1 of particulate solid to liquid.

As alternatives or in addition to olivine (also known as forsterite)—which depending on its composition has a Moh hardness of between 6.5 to 7—other minerals such as andalusite, spodumene, diaspore, congolite, spessartime and andsine may also be used. In addition, man-made materials in the form of a particulate solid of the requisite hardness range may also be used.

The particulate solid can have a particle size of 60 to 100 mesh. It has been found rather than simply removing the coating. A mixture of particles having differing mesh sizes could also be used.

The water used can, in addition to coming from the domestic supply, also be fresh water or sea water. If sea water is used then the surface should preferably be rinsed off with domestic supply water, prior to its beng re-coated. As alternatives to or in addition to water, certain organic or inorganic solvents may also be employed. Examples of solvents which can be employed are alkyl alcohols, such as ethanol, propanol, iso-propanol, ethylene glycol or proplene glycol. Other solvents which may be contemplated include acetone, butanone and sulpholane. Especially suitable are those which may have a solublising or swelling effect on the surface coating being removed, thus rendering it more easily removable. When necessary, suitable measures will need to be taken to protect the operator and the environment from these solvents.

In addition to liquids as described above, other fluids may be employed, either partially or fully in their place. Suitable examples of fluids which may be used include air or nitrogen.

The water supplied from a domestic or external source is normally provided at a temperature of below 20C. Where necessary however it may be heated up to about 50C. Heating the water to a temperature of between 25 to 40C has been found to reduce water consumption. The heating may be accomplished by means of an independent heating element mounted within the blasting pot or alternatively to the water inlet supply. As an alternative, where a petrol or diesel powered generator is used to operate for example a compressor to produce compressed air, then the exhaust pipe can pass through the water, on its way to the gasses being vented, and the heat from the exhaust can be utilised to raise the temperature of the water.

The apparatus used can conveniently by bolted to a trailer or other suitable transporting vehicle to enable it to be taken more easily to where it is required. This will also allow for example, a supply of water for spraying to be taken, where it would otherwise be difficult to obtain.

It will of course be understood that the invention is not limited to the specific details described herein, which are given by way of example only, and that various modifications and alterations are possible with the scope of the appended claims.

What is claimed is:

1. A method of removing a coating from a surface, the method comprising:

(i) selecting a particulate solid suitable for removing the coating from the surface, the particular solid having a particle size from 150 to 250 $\mu$m;

(ii) selecting a fluid as a carrier for the particulate solid;

(iii) heating the fluid to a temperature of from 25 to 50 C;

(iv) distributing the particulate solid in the fluid to form a spray mixture;

(v) generating a pressurised jet to the spray mixture;

(vi) impacting onto a coating the pressurised jet of spray mixture to remove the coating.

2. A method according to claim 1, wherein the particulate solid has a particle size of from 170 to 190 $\mu$m.

3. A method according to claim 1, wherein the hardness of the particulate solid is less than 8.0 on the Moh scale.

4. A method according to claim 3, wherein the hardness of the particulate solid is from 6.0 to 7.0 on the Moh scale.

5. A method according to claim 1, wherein the particulate solid is olivine.

6. A method according to claim 1, wherein the fluid is heated to a temperature of from 25 to 40 C.

7. A method according to claim 1, wherein the fluid is a liquid.

8. A method according to claim 7, wherein the liquid is water.

9. A method according to claim 7, wherein the solid to liquid volumetric ratio in the spray mixture is approximately 2:1.

10. A method according to claim 1, wherein the mixture is directed so as to impact the coating at an angle of approximately 45°.

11. A method according to claim 1, wherein the jet spray is moved, in use, in a circular motion back and forth across the coating.

12. A method according to claim 1, wherein the pressure applied to the spray mixture to generate the spray is from $3_x10^5$ to $1.5_x10^6$ $Nm^{-2}$.

13. A method according to claim 10 where the pressure is from $4_x10^5$ to $1_x10^6$ $Nm^{-2}$.

* * * * *